US009580774B2

(12) United States Patent
Rettig et al.

(10) Patent No.: US 9,580,774 B2
(45) Date of Patent: Feb. 28, 2017

(54) CREEP-RESISTANT, RHENIUM-FREE NICKEL BASE SUPERALLOY

(71) Applicant: MTU AERO ENGINES AG, Munich (DE)

(72) Inventors: Ralf Rettig, Erlangen (DE); Robert F. Singer, Erlangen (DE); Harald Helmer, Erlangen (DE); Steffen Neumeier, Erlangen (DE)

(73) Assignee: MTU AERO ENGINES AG, Munich (DE)

( * ) Notice: Subject to any disclaimer, the term of this patent is extended or adjusted under 35 U.S.C. 154(b) by 708 days.

(21) Appl. No.: 14/061,190

(22) Filed: Oct. 23, 2013

(65) Prior Publication Data

US 2014/0119941 A1 May 1, 2014

(30) Foreign Application Priority Data

Oct. 26, 2012 (EP) ..... 12190156

(51) Int. Cl.
*C22C 19/05* (2006.01)
*F01D 5/14* (2006.01)
(Continued)

(52) U.S. Cl.
CPC ..... *C22C 19/057* (2013.01); *C22C 19/056* (2013.01); *C22F 1/10* (2013.01); *F01D 5/28* (2013.01)

(58) Field of Classification Search
CPC ..... C22C 19/056; C22C 19/057; C22F 1/10; F01D 5/28
See application file for complete search history.

(56) References Cited

U.S. PATENT DOCUMENTS 6,039,920 A * 3/2000 Koch ..... C22C 1/03 420/129
6,221,181 B1 * 4/2001 Bossmann ..... C22C 1/0433 148/410
(Continued)

FOREIGN PATENT DOCUMENTS

EP 2305847 A1 4/2011
EP 2305848 A1 4/2011
(Continued)

OTHER PUBLICATIONS

Heck!, S. Neumeier, M. Goken, R.F. Singer, "The effect of Re and Ru on γ/γ'microstructure, γ-solid solution strengthening and creep strength in nickel-base superalloys", in Material Science and Engineering A 528 (2011) 3435-3444.
(Continued)

*Primary Examiner* — John K Fristoe, Jr.
*Assistant Examiner* — Woody Lee, Jr.
(74) *Attorney, Agent, or Firm* — Abel Law Group, LLP

(57) ABSTRACT

Disclosed is a nickel base alloy which is substantially free of rhenium and has a solidus temperature of more than 1320° C. Precipitates of a γ'-phase are present in a γ-matrix with a fraction of 40 to 50 vol % at 1050° C. to 1100° C., and a γ/γ' mismatch at 1050° C. to 1100° C. is from −0.15% to −0.25%. The alloy comprises 11 to 13 at % aluminum, 4 to 14 at % cobalt, 6 to 12 at % chromium, 0.1 to 2 at % molybdenum, 0.1 to 3.5 at % tantalum, 0.1 to 3.5 at % titanium, 0.1 to 3 at % tungsten. The tungsten content of the γ-matrix is greater than that in the precipitated γ'-phases.

20 Claims, 1 Drawing Sheet

P808114/EP/1 Oct 25, 2012

(51) Int. Cl.
*F01D 5/28* (2006.01)
*C22F 1/10* (2006.01)

(56) References Cited

U.S. PATENT DOCUMENTS

| | | | | |
|---|---|---|---|---|
| 2002/0062886 | A1* | 5/2002 | Hino | C22C 19/057 148/562 |
| 2010/0135846 | A1* | 6/2010 | Cetel | C22C 19/057 420/443 |
| 2011/0076180 | A1 | 3/2011 | Suzuki et al. | |
| 2011/0076181 | A1 | 3/2011 | Suzuki et al. | |
| 2011/0076182 | A1* | 3/2011 | Suzuki | C22C 19/057 420/448 |
| 2011/0120597 | A1 | 5/2011 | O'Hara et al. | |
| 2013/0230405 | A1 | 9/2013 | O'Hara et al. | |

FOREIGN PATENT DOCUMENTS

| | | | |
|---|---|---|---|
| EP | 2314727 | A1 | 4/2011 |
| WO | 2009032578 | A1 | 3/2009 |
| WO | 2009032579 | A1 | 3/2009 |

OTHER PUBLICATIONS

Paul J. Fink, Joshua L. Miller, Douglas G. Konitzer, "Rhenium Reduction—Alloy Design Using an Economically Strategic Element", JOM, 62(2010), 55-57.

* cited by examiner

P808114/EP/1 Oct 25, 2012
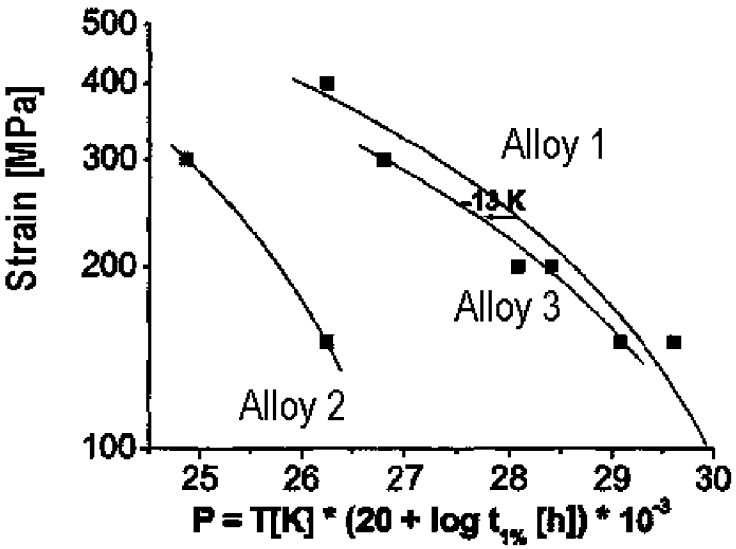

CREEP-RESISTANT, RHENIUM-FREE NICKEL BASE SUPERALLOY

CROSS-REFERENCE TO RELATED APPLICATIONS

The present application claims priority under 35 U.S.C. §119 of European Patent Application No. 12190156.5, filed Oct. 26, 2012, the entire disclosure of which is expressly incorporated by reference herein.

BACKGROUND OF THE INVENTION

1. Field of the Invention

The present invention relates to a nickel base alloy which is substantially free of rhenium yet at the same time achieves the creep resistance properties of the second-generation nickel base superalloys.

2. Discussion of Background Information

In gas turbines, such as fixed gas turbines or aero engines, nickel base superalloys are used, for example, as blade materials, since even at the high operating temperatures these materials still have sufficient strength for the high mechanical loads. For example, in fixed gas turbines or jet engines in commercial aircraft, turbine blades are exposed to a stream of exhaust gas at temperatures of up to 1500° C. and at the same time are subject to very high mechanical loads as a result of centrifugal forces. Under these conditions it is particularly important for the creep resistance of the material used to meet the requirements. To raise the creep resistance further, turbine blades have for a number of decades also been produced in monocrystalline form, in order, through the avoidance of grain boundaries, to achieve further improvement in the creep resistance.

With the so-called second-generation and third-generation nickel base superalloys that are presently in use, the alloys typically include the chemical element rhenium, with a fraction of three or six percent by weight, since rhenium further improves the creep resistance.

However, in view of the scant availability of rhenium, the admixing of rhenium is very expensive. In the prior art, accordingly, there have already been efforts to reduce the fraction of rhenium or to do without the alloying of rhenium entirely, while at the same time maintaining the mechanical properties, especially with regard to the creep resistance. Relevant studies include those by A. Heckl, S. Neumeier, M. Göken, R. F. Singer, "The effect of Re and Ru on γ/γ' microstructure, γ-solid solution strengthening and creep strength in nickel-base superalloys", in Material Science and Engineering A 528 (2011) 3435-3444, and by Paul J. Fink, Joshua L. Miller, Douglas G. Konitzer, "Rhenium Reduction—Alloy Design Using an Economically Strategic Element", JOM, 62(2010), 55-57. Furthermore, such alloys are also subject matter of patent applications, as for example in EP 2 305 847 A1, EP 2 305 848 A1, EP 2 314 727 A1, US 2010/0135846 A1, WO 2009/032578 A1, and WO 2009/032579 A1. The entire disclosures of the documents mentioned above are incorporated by reference herein.

Although, therefore, there have already been some proposed solutions for a reduction in rhenium or for rhenium-free nickel base superalloys, there continues to be a need to develop reduced-rhenium or rhenium-free nickel base superalloys whose mechanical properties, especially high-temperature properties, such as creep resistance, are situated within the range of the rhenium-containing nickel base superalloys presently in use, or which avoid the use of certain elements such as hafnium.

It is desirable, therefore, to provide a nickel base superalloy which has comparable mechanical properties, especially high-temperature properties, such as creep resistance, with second-generation and third-generation nickel base superalloys that are currently in use, but which does away entirely with the alloying of the element rhenium. Furthermore, the alloy is to be capable of production economically and efficiently, and more particularly is to be readily castable and also monocrystalline or amenable to directional solidification.

SUMMARY OF THE INVENTION

The present invention provides a nickel base alloy as set forth in the appended claims, as well as a corresponding article, more particularly a component of a gas turbine, as also set forth in the appended claims.

A basis for the invention is the finding that rhenium in the nickel base superalloys contributes in particular to the solid solution hardening of the γ-matrix of the nickel base superalloys. In order to be able effectively to replace rhenium, therefore, an alloying constituent must be present which takes over the function of solid solution hardening from rhenium. This is the entry point for the invention, which proposes that tungsten can be used as an efficient solid solution hardener in the alloy. Tungsten, however, is typically present not only in the γ-matrix of nickel base superalloys, but also in the precipitated γ'-phases, which are typically formed by $Ni_3Al$ or $Ni_3Ti$ or mixtures thereof. The invention comes in here, proposing nickel base superalloys in which, subject to specified boundary conditions, the alloy composition is optimized such that the tungsten content of the γ-matrix is greater than in the precipitated γ'-phases.

For this purpose it is proposed in accordance with the invention that as a boundary condition the alloy is given a specified chemical composition with an aluminum content of from 11 to 13 at % (atom %), a cobalt content of from 4 to 14 at %, a chromium content of from 6 to 12 at %, a molybdenum content of from 0.1 to 2 at %, a tantalum content of from 0.1 to 3.5 at %, a titanium content of from 0.1 to 3.5 at %, a tungsten content of from 0.1 to 3 at %, and nickel and unavoidable impurities as the remainder. Further as a boundary condition, an alloy of this kind is to have a solidus temperature of more than 1320° C., and the fraction of the γ'-phase is to be in the range of from 40 to 50 vol %, more particularly in the range of from 44 to 46 vol %, at a temperature in the range from 1050° C. to 1100° C. Additionally as a boundary condition it shall be specified that the γ/γ' mismatch at temperatures of from 1050° C. to 1100° C. is in the range of from −0.15% to −0.25%. The γ/γ' mismatch is defined as the standardized difference in the lattice constants of the two phases γ and γ':

$$\frac{a'_\gamma - a_\gamma}{1/2*(a'_\gamma + a_\gamma)}$$

In order then to render the alloy creep-resistant, the composition is selected such that the fraction of tungsten in the γ-matrix is greater than that in the γ'-phase. An alloy with a composition of this kind, with a correspondingly high tungsten content in the γ-matrix, has the required mechanical strength at high temperatures, and more particularly the required creep resistance. It is in fact also conceivable to increase the tungsten content overall, such that as a result the tungsten content of the γ-matrix is increased as well. This, however, raises the density of the alloy, and so it is advantageous to bring about a corresponding improvement in the ratio of the tungsten content of matrix to γ' precipitates. The composition of the alloy can be varied within the stated limits or boundary conditions.

According to one embodiment of the invention, the alloy composition may be selected such that at a temperature of from 1050° C. to 1100° C., the tungsten content of the γ-matrix is ≥3.5 at %.

Preferably, however, the chemical composition is selected such that the tungsten content of the γ-matrix is at maximum.

This can be achieved more particularly in that for a minimum aluminum content a maximum tantalum content and a medium titanium content are set. It has emerged, indeed, that through the tantalum and titanium contents in particular and also through the aluminum content it is possible to vary the concentration of tungsten in the γ-matrix.

Accordingly, the tantalum content and the titanium content together may be set at a level of ≥3 at %, particularly ≥4.5 at %, more particularly ≥5 at %.

Consequently, a nickel base alloy may have the following chemical composition: aluminum from 11 to 12 at %, cobalt from 8 to 10 at %, chromium from 6 to 8 at %, molybdenum from 0.5 to 1.5 at %, tantalum from 2 to 3.5 at %, titanium from 1 to 2 at %, tungsten from 2 to 3 at %, and nickel and unavoidable impurities as the remainder.

According to a further embodiment, a nickel base alloy according to the present invention may have the following chemical composition: aluminum from 11 to 11.2 at %, cobalt from 9.1 to 9.3 at %, chromium from 6 to 6.2 at %, molybdenum from 0.85 to 1.0 at %, tantalum from 3.3 to 3.5 at %, titanium from 1.5 to 1.7 at %, tungsten from 2.8 to 3 at %, and nickel and unavoidable impurities as the remainder.

In addition to the alloying constituents mentioned above, further elements may be present in the form of trace elements, whose amount may be limited to the following ranges: bismuth from 0 to 0.00003 wt % (weight percent), selenium from 0 to 0.0001 wt %, thallium from 0 to 0.00005 wt %, lead from 0 to 0.0005 wt %, and tellurium from 0 to 0.0001 wt %.

It has emerged, furthermore, that a fraction of from 0.05 to 0.3 wt %, more particularly from 0.1 to 0.2 wt %, of hafnium is advantageous, and may have effects including an improvement in the grain boundary strength and fracture life.

Furthermore, the sulfur content may be limited to not more than 2 ppm (parts per million), more particularly not more than 1 ppm of sulfur, in order to improve further the mechanical properties.

With the alloy of the invention it is possible in particular to manufacture articles, such as components of gas turbines, preferably turbine blades, and the like, which may be monocrystalline or with directional solidification.

BRIEF DESCRIPTION OF THE DRAWING

The appended FIGURE shows a Larson-Miller plot for illustrating the creep resistance of the alloy of the invention in comparison to known alloys and to a comparison alloy.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention in more detail than is necessary for the fundamental understanding of the present invention, the description in combination with the drawing making apparent to those of skill in the art how the several forms of the present invention may be embodied in practice.

Working Example

In accordance with the invention, an alloy was produced whose composition can be seen from the table below (Alloy 3). As comparison alloys, Alloys 1 and 2 were selected, with Alloy 1 corresponding substantially in terms of chemical composition to that of the material CMSX-4, and Alloy 2 being an alloy having a composition similar to that of the material CMSX-4, but with the rhenium absent. The constituents of the alloys are given in weight percent in the table.

| Alloy | Al | Co | Cr | Mo | Ta | Ti | W | Re | Hf | Ni |
|---|---|---|---|---|---|---|---|---|---|---|
| Alloy 1 | 5.6 | 9.0 | 6.5 | 0.6 | 6.5 | 1.0 | 6.0 | 3.0 | 0.1 | remainder |
| Alloy 2 | 6.1 | 8.9 | 5.3 | 1.0 | 6.7 | 0.0 | 6.2 | 0.0 | 0.0 | remainder |
| Alloy 3 | 4.8 | 8.6 | 5 | 1.4 | 10.1 | 1.3 | 8.8 | 0.0 | 0.0 | remainder |

As can be seen from the appended FIGURE, which shows a plot known as a Larson-Miller plot, Alloy 3 according to the present invention has a creep resistance similar to that of Alloy 1, which corresponds to a second-generation nickel base superalloy. In contrast, Alloy 2 has a very much lower creep resistance, as a result of the lack of rhenium fraction and the lack of optimization of the alloy composition in accordance with the present invention. It is therefore clear that through the teaching of the invention it is possible to provide nickel base superalloys which are able to do without the poorly available element rhenium but which nevertheless are able to provide high-temperature mechanical properties, such as a corresponding creep resistance, for example, like those of known, rhenium-containing alloys.

While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A nickel base alloy, wherein the alloy is substantially free of rhenium and has a solidus temperature of more than 1320° C., wherein precipitates of a γ'-phase are present in a γ-matrix with a fraction of from 40 to 50 vol % at temperatures of from 1050° C. to 1100° C., and a γ/γ' mismatch at temperatures of from 1050° C. to 1100° C. is from −0.15% to −0.25%, and wherein the alloy comprises:

aluminum from 11 to 12 at %,
cobalt from 8 to 10 at %,
chromium from 6 to 8 at %,
molybdenum from 0.5 to 1.5 at %,
tantalum from 2 to 3.5 at %,
titanium from 1 to 2 at %,
tungsten from 2 to 3 at %,
hafnium from 0.05 to 0.3 wt % or absent,
remainder nickel and unavoidable impurities, a tungsten content of the γ-matrix being greater than a tungsten content of the precipitates of the γ'-phase.

2. The nickel base alloy of claim 1, wherein the tungsten content of the γ-matrix at a temperature of 1100° C. is greater than 3.5 at %.

3. The nickel base alloy of claim 1, wherein tungsten content and molybdenum content of the γ-matrix together are more than 5 at %.

4. The nickel base alloy of claim 1, wherein tantalum content and titanium content together are greater than or equal to 3 at %.

5. The nickel base alloy of claim 1, wherein tantalum content and titanium content together are greater than or equal to 4.5 at %.

6. The nickel base alloy of claim 1, wherein tantalum content and titanium content together are greater than or equal to 5 at %.

7. The nickel base alloy of claim 1, wherein the alloy comprises:

aluminum from 11 to 11.2 at %,
cobalt from 9.1 to 9.3 at %,
chromium from 6 to 6.2 at %,
molybdenum from 0.85 to 1.0 at %,
tantalum from 3.3 to 3.5 at %,
titanium from 1.5 to 1.7 at %,
tungsten from 2.8 to 3 at %.

8. The nickel base alloy of claim 7, wherein the alloy comprises from 0.05 to 0.3 wt % of hafnium.

9. An article which comprises or consists of the nickel base alloy of claim 7.

10. The nickel base alloy of claim 1, wherein the alloy comprises one or more of the following trace elements:

bismuth from 0 to 0.00003 wt %,
selenium from 0 to 0.0001 wt %,
thallium from 0 to 0.00005 wt %,
lead from 0 to 0.0005 wt %, and
tellurium from 0 to 0.0001 wt %.

11. The nickel base alloy of claim 1, wherein the alloy comprises from 0.05 to 0.3 wt % of hafnium.

12. The nickel base alloy of claim 1, wherein the alloy comprises from 0.1 to 0.2 wt % of hafnium.

13. The nickel base alloy of claim 1, wherein hafnium is absent.

14. The nickel base alloy of claim 1, wherein a sulfur content is less than or equal to 2 ppm.

15. The nickel base alloy of claim 1, wherein a sulfur content is less than or equal to 1 ppm.

16. An article which comprises or consists of the nickel base alloy of claim 1.

17. The article of claim 16, wherein the article is monocrystalline.

18. The article of claim 16, wherein the article has undergone directional solidification.

19. The article of claim 16, wherein the article is an engine component.

20. The article of claim 19, wherein the article is a turbine blade of a gas turbine.

* * * * *